US007260343B2

(12) United States Patent
Baek et al.

(10) Patent No.: US 7,260,343 B2
(45) Date of Patent: Aug. 21, 2007

(54) GEAR ASSEMBLY USED WITH AN IMAGE FORMING APPARATUS, AN OPTICAL PHOTOCONDUCTIVE (OPC) UNIT HAVING THE SAME, AND A METHOD OF DRIVING THE GEAR ASSEMBLY

(75) Inventors: Chung-guk Baek, Suwon-si (KR); Yong-baek Yoo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 60 days.

(21) Appl. No.: 10/872,494

(22) Filed: Jun. 22, 2004

(65) Prior Publication Data

US 2005/0084292 A1 Apr. 21, 2005

(30) Foreign Application Priority Data

Oct. 20, 2003 (KR) ..... 10-2003-0072887

(51) Int. Cl.
*G03G 15/00* (2006.01)

(52) U.S. Cl. ..... 399/167

(58) Field of Classification Search ..... 399/167, 399/117, 357, 358

See application file for complete search history.

(56) References Cited

U.S. PATENT DOCUMENTS

| | | | | |
|---|---|---|---|---|
| 4,674,865 | A * | 6/1987 | Tada et al. | 399/102 |
| 5,237,377 | A * | 8/1993 | Harada et al. | 399/354 |
| 5,303,004 | A * | 4/1994 | Maruyama et al. | 399/75 |
| 5,323,213 | A * | 6/1994 | Ahn | 399/75 |
| 5,508,793 | A * | 4/1996 | Kimura et al. | 399/63 |
| 6,078,763 | A * | 6/2000 | Hoshi | 399/111 |
| 2005/0084292 | A1 * | 4/2005 | Baek et al. | 399/167 |

FOREIGN PATENT DOCUMENTS

| | | | |
|---|---|---|---|
| JP | 01-211773 | | 8/1989 |
| JP | 05-289581 | | 11/1993 |
| JP | 09-274359 | | 10/1997 |
| JP | 10-020599 | | 1/1998 |
| JP | 2000284668 | A * | 10/2000 |
| JP | 2002-156891 | | 5/2002 |
| JP | 2002-207331 | | 7/2002 |
| KR | 0950443 | B1 * | 5/1995 |

* cited by examiner

*Primary Examiner*—Quana Grainger
(74) *Attorney, Agent, or Firm*—Stanzione & Kim, LLP

(57) ABSTRACT

An organic photoconductive (OPC) unit of an image forming apparatus and a gear assembly arranged in the OPC unit. The gear assembly includes a drum gear formed on a flange of an OPC drum, a cleaning gear driven by a receiving power from the drum gear, and at least one idle gear interposed between the drum gear and the cleaning gear and transmitting the rotational force of the drum gear to the cleaning gear. Therefore, it is possible to drive a plurality of additional rollers with a single power source, and easy to connect the OPC drum with the gears when the OPC drum is fitted into the OPC unit. In addition, because the gear assembly is constructed in a compact form, it is possible to reduce the volume of the OPC unit.

33 Claims, 5 Drawing Sheets

GEAR ASSEMBLY USED WITH AN IMAGE FORMING APPARATUS, AN OPTICAL PHOTOCONDUCTIVE (OPC) UNIT HAVING THE SAME, AND A METHOD OF DRIVING THE GEAR ASSEMBLY

CROSS-REFERENCE TO RELATED APPLICATIONS

This application claims the benefit of Korean Patent Application No. 2003-72887, filed on Oct. 20, 2003, in the Korean Intellectual Property Office, the disclosure of which is incorporated herein in its entirely.

BACKGROUND OF THE INVENTION

1. Field of the Invention

The present general inventive concept relates to an image forming apparatus, and in particular, to a gear assembly to which power is easily and effectively transmitted from a main body of the image forming apparatus, and an optical photoconductive (OPC) drum unit provided with the gear assembly.

2. Description of the Related Art

In general, an OPC drum of a mono image forming apparatus is provided in one housing together with a developing roller, a toner transfer roller or the like, and a developing unit and an optical photoconductive (OPC) unit are not separately provided.

Therefore, a driving source of the OPC drum and a cleaning member for cleaning an electrification roller which electrifies the OPC drum, are usually fitted on the housing or other support member, and the developing member is driven by a separate driving source. In addition, waste toner is removed from the OPC drum by a cleaning blade, which is in contact with the OPC drum, and then freely drops; a waste toner transfer means is not separately provided.

In the case of recently developed color image forming apparatuses, an OPC unit and a developing unit are separately provided and the OPC unit comprises four color developing units, each for one of four colors, i.e., yellow, magenta, cyan and black.

Such color image forming apparatuses can be classified into a single path type and a multi-path type depending on the methods for forming and printing a color image on a recording medium.

A single path type image forming apparatus comprises a plurality of respective color developers and a plurality of OPC mediums. That is, a yellow developer, a magenta developer, a cyan developer and a black developer correspond to a first OPC medium, a second OPC medium, a third OPC medium and a fourth OPC medium, respectively, whereby individual color images are formed and then are transferred onto a single image transfer unit. Such a single path type image forming apparatus has an advantage in that the first to fourth OPC mediums can be constructed in a drum type that is easy to control rotational speed. However, because it is necessary to use a plurality of OPC mediums and to employ a plurality of laser scanning units (LSU), the volume of the image forming apparatus is increased and the price is high.

Contrary to this, in a multi-path type image forming apparatus, a plurality of developers selectively perform development on one OPC unit, in such a manner that during the first rotation of an OPC medium of the OPC unit, the yellow developer performs development, during the second rotation of the OPC medium, the magenta developer performs development, during the third rotation, the cyan developer performs development, and during the fourth rotation, the black developer performs development. Thereafter, an image, in which the colors are developed overlapping each other, is transferred to the image transfer unit at one time.

Such a multi-path type image forming apparatus has an advantage in that the entire volume can be reduced and the manufacturing costs can be lowered because only one OPC medium is used. However, because the OPC medium is formed in a belt type, there is a limit in properly controlling the rotational speed of the belt, and in the case of long-term use, the tension of the belt is weaken, whereby sometimes a defect may be caused in a color image.

Due to these problems of the prior art, there is a need to develop a drum type OPC medium to be used even in the multi-path type image forming apparatus. In particular, a need has been raised to develop an OPC unit in which yellow, magenta, cyan and black developers are fixed for stability in development, a cleaning roller that cleans an electrification roller and an auger that transfers waste are integrated within one OPC unit, and a power transmission system to effectively drive the cleaning roller and the auger.

SUMMARY OF THE INVENTION

Accordingly, the present general inventive concept has been made to solve the above-mentioned problems occurring in the prior art, and an aspect of the present general inventive concept is to provide a gear assembly built in an OPC unit in a compact form and capable of driving a cleaning roller and an auger roller with one driving source.

Another aspect of the present general inventive concept is to provide an OPC unit in which a gear assembly providing power transmission is completed concurrently with fitting an OPC drum into the OPC unit.

Yet another aspect of the present invention is to provide a gear assembly which is excellent in gear-to-gear engagement efficiency and in which a secession of a gear cannot be easily caused, and an OPC unit provided with the same.

Additional aspects and advantages of the present general inventive concept will be set forth in part in the description which follows and, in part, will be obvious from the description, or may be learned by practice of the general inventive concept.

The foregoing and/or other aspects of the present general inventive concept are achieved by providing a gear assembly including a drum gear formed on a flange of an OPC drum, a cleaning gear driven by receiving power from the drum gear, and at least one idle gear interposed between the drum gear and the cleaning gear and transmitting the rotational force of the drum gear to the cleaning gear.

The gear assembly may further include an auger gear rotated by receiving power from the cleaning gear. According to this construction, it is possible to drive not only the cleaning roller that cleans an electrification roller, but also the auger roller that transfers waste toner using a single power source. In addition, the gear assembly may further include at least one idle gear interposed between the cleaning gear and the auger gear that transmits the rotational force of the cleaning gear to the auger gear. By adding the at least one idle gear in this manner, there is an advantage in that it is possible to freely tune the distance between the auger gear and the cleaning gear.

Each of the cleaning gear and the auger gear may be provided with a flange in a side thereof in order to prevent the at least one idle gear from slipping away from the gear assembly. As a result, it is possible to prevent the at least one idle gear interposed between the cleaning gear and the auger gear from slipping away from the gear assembly.

In addition, the at least one idle gear interposed between the drum gear and the cleaning gear may include a first idle gear engaged with the drum gear, a third idle gear engaged with the cleaning gear, and a second idle gear engaged with the first and third idle gears.

Here, the drum gear may include a helical gear and may have an outer diameter smaller than that of the OPC drum. According to this construction, it is possible to properly tune the rotational force of the cleaning gear and the auger gear by the rotation of the OPC drum.

The foregoing and/or other aspects of the present general inventive concept may also be achieved by providing a gear assembly including a drum gear formed on a flange of an OPC drum, the outer diameter of the drum gear being smaller than that of the OPC drum, a cleaning gear driven by receiving power from the drum gear, the cleaning gear being provided in a side of a housing assembly, an auger gear driven by receiving power from the cleaning gear, and at least one idle gear provided in a side of the housing assembly and interposed between the drum gear and the cleaning gear to transmit the rotational force of the drum gear to the cleaning gear. Accordingly, because all gears except the drum gear are arranged to be capable of being installed in the housing assembly, it is convenient in that the assembling of the gear assembly is completed concurrently with fitting the OPC drum into the housing assembly.

Here, the at least one idle gear may include a first idle gear engaged with the drum gear, a third gear engaged with the cleaning gear, and a second idle gear engaged with the first and third idle gears. As described above, each of the cleaning gear, the auger gear and the second idle gear is provided with a flange in a side thereof in order to prevent the at least one idle gear from slipping away from the gear assembly.

In order to maximize gear-to-gear power transmission efficiency, it is preferable that the drum gear, the first idle gear and the second idle gear include helical gears, respectively, and the gear assembly further includes at least one idle gear engaged with the cleaning gear and the auger gear.

The foregoing and/or other aspects of the present general inventive concept may also be achieved by providing an organic photoconductive (OPC) unit of an image forming apparatus including an OPC drum, a housing assembly to protect the OPC drum, the housing assembly including a cleaning roller and a auger roller that transfers waste toner, and a gear assembly that drives the OPC drum, the cleaning roller and the auger roller using one power source provided from a main body of an image forming apparatus. As a result, it is possible to construct an OPC unit of an image forming apparatus in a compact form.

The gear assembly may include a drum gear formed on a side of the OPC drum, a cleaning gear receiving power from the drum gear and rotating the cleaning roller, and an auger gear receiving power from the cleaning gear and rotating the auger gear.

The gear assembly may further include at least one idle gear that transmits the rotational force of the drum gear to the cleaning gear between the drum gear and the cleaning gear, and at least one idle gear interposed between the cleaning gear and the auger gear to transmit the rotational force of the cleaning gear to the auger gear. According to this construction, it is possible to freely tune the distance between the drum gear and the cleaning gear and the distance between the cleaning gear and the auger gear.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
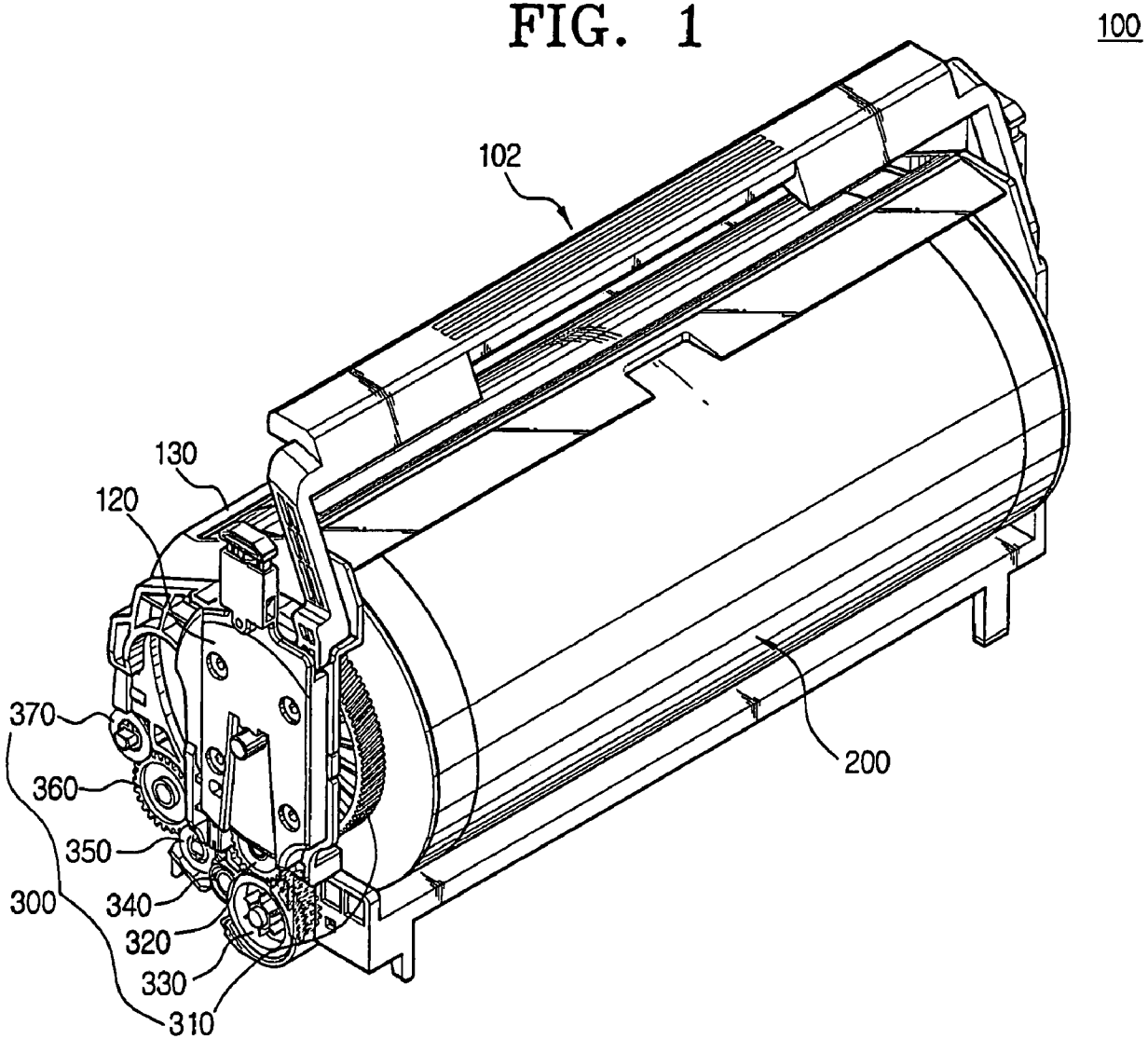
FIG. 1 is a perspective view illustrating an OPC unit according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
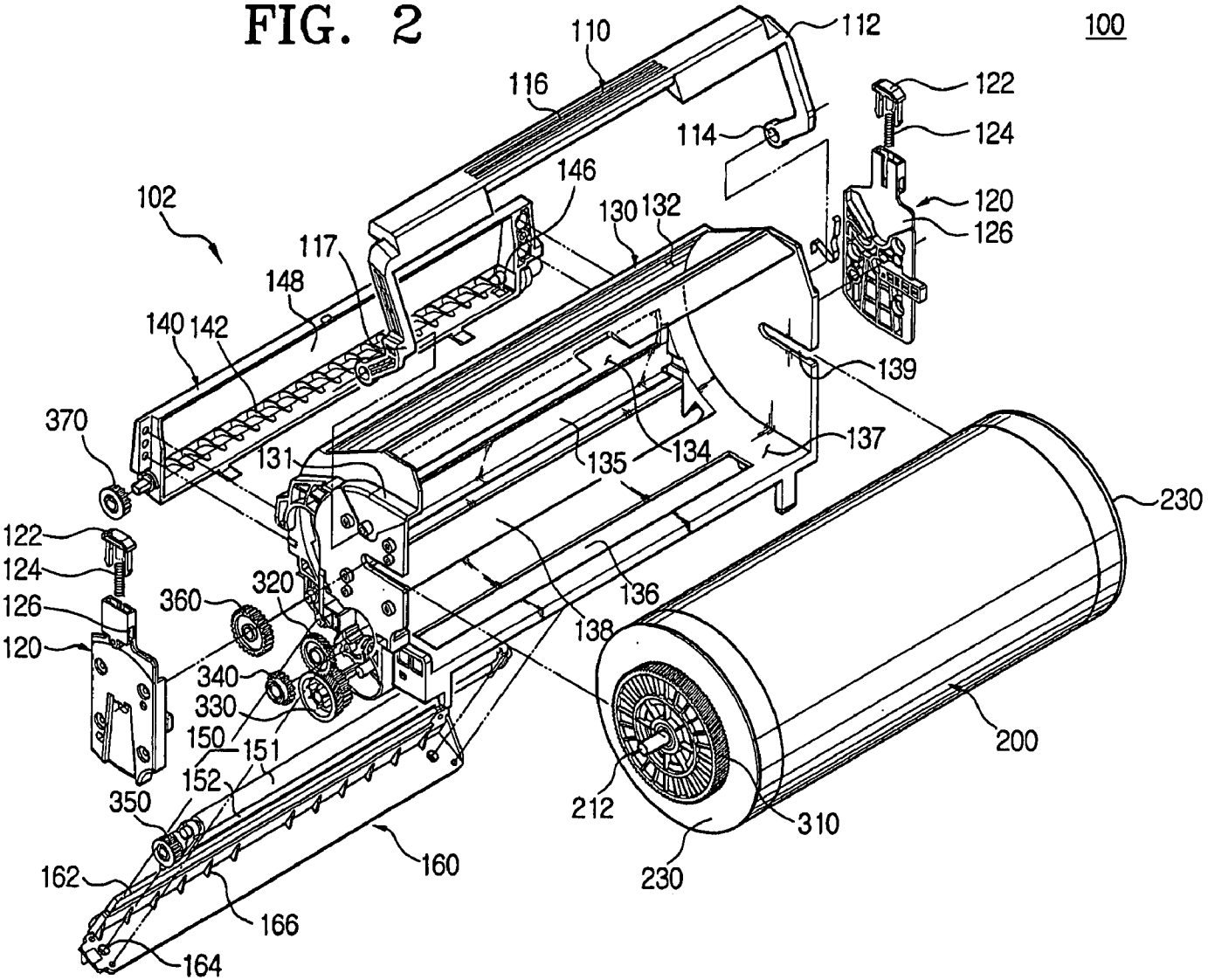
FIG. 2 is an exploded perspective view of the OPC unit shown in FIG. 1.

FIG. 1 is a perspective view illustrating an OPC unit according to an embodiment of the present general inventive concept, and FIG. 2 is an exploded perspective view of the OPC unit shown in FIG. 1.

As can be seen from FIGS. 1 and 2, the inventive OPC unit 100 can include a housing assembly 102, an OPC drum 200, and a gear assembly 300.

The housing assembly 102 may include a main housing 130, a first sub-housing 140, a second sub-housing 160, a bracket 120 and a handle 110, as shown in FIG. 2.

The main housing 130 may be formed with a main opening 137, and first to fourth sub-openings 132, 134, 136 and 138. The main opening 137 can be an open space occupying about half of the main housing 130, into which an OPC drum 200 is fitted. As can be seen from FIG. 2, a drum axle 212 can be inserted into a pair of slits 139 along the main opening 130, and then brackets 120 may be secured to the main housing, whereby the OPC unit 100 is completed.

The first sub-opening 132 may be formed on the upper end of the main housing 130, where an image transfer unit (not shown) is mounted, and the first sub-opening 132 can serve as a passage that transfers an image developed on the OPC drum 200 onto the image transfer unit.

The second sub-opening 134 can be formed below the lower end of the first sub-opening 132, as can be seen from FIG. 2, and the second sub-opening 134 can be provided with a cleaning blade 135 at the lower end thereof. The first sub-housing 140 to be described later can be assembled in the second opening 134 to transfer waste toner, which is removed from the OPC drum 200 by the cleaning blade 135, into a waste toner sump (not shown).

The third sub-opening 136 can be formed in the bottom of the main housing 130 in a rectangular shape. A laser scanning unit (LSU) (not shown), which forms an image on the OPC drum using laser beam, can be positioned at the bottom end of the third opening 136 and to form an image to be transferred on the OPC drum 200 through the third sub-opening 136.

The fourth sub-opening 138 can be formed between the second sub-opening 134 and the third sub-opening 136, and the sub-housing 160 and an electrification roller unit 150 as shown in FIG. 2 can be mounted in the fourth sub-opening 110. That is, the electrification roller unit 150 consisting of an electrification roller 151 and a cleaning roller 152 and can be mounted through the fourth sub-opening 138 to be in contact with the OPC drum 200, and the second sub-housing 160 can be connected to the main housing 130, thereby enclosing the fourth sub-opening 138.

An auger roller 142 can be mounted inside of the first sub-housing 140 to transfer waste toner toward a waste toner drop hole 146 and an auger roller gear 370 can be provided on a side of the auger roller 142. A carriage space 148 can be formed inside of the first sub-housing 140, which is capable of temporarily carrying the waste toner removed from the OPC drum 200. The first sub-housing 140 can be connected to the main housing 130, thereby enclosing the second sub-opening 134.

The second sub-housing 160 can be provided with an electrostatic elimination light guide 162 in a side thereof and formed with a plurality of ribs 166 on the inner surface. In addition, a plurality of screw holes 164 can be formed in the second sub-housing for a screw connection. The electrostatic elimination light guide 162 serves to guide electrostatic elimination light to the OPC drum 200 to eliminate static electricity from the OPC drum 200 and it is desirable to form the light guide to be transparent or semi-transparent. The plurality of ribs 166 prevent the toner removed by the cleaning roller 152 from being scattered due to the rotation of the OPC drum 200, the electrification roller 151 and the cleaning roller 152.

As shown in FIG. 2, the brackets 120 can be mounted on the opposite sides of the main housing 130 via a plurality of screws and each bracket may include a shock absorbing bar 122, a coil spring 124, and a support member 126. The shock absorbing bar 122 can be in contact with the image transfer unit (not shown) when the image transfer unit is seated on the top end of the housing assembly 102, the coil spring 124 can elastically support the bottom of the shock absorbing bar 122, and the support member 126 can receive the coil spring 124 and the shock absorbing bar 122 and be secured on the main housing 130. As a result, when the image transfer unit (not shown) is seated on the top end of the housing assembly 102, the bracket 120 absorbs an impact.

The handle 110 can be provided with openings 114, so that it can be hingedly connected to the opposite sides of the main housing 130, and can include an anti-slip part 116 and a lateral leg part 112 at each end thereof. Each of the lateral leg parts 112 can be formed with a hook part 117 to be latched in a flange seating part 131 in the main housing 130.

As shown in FIG. 2, the OPC drum 200 is a cylindrical drum and an image will be formed on the OPC drum 200. A flange 230 is fitted onto each side of the OPC drum 200 and the drum axle 212 extends through the center of the flange. Such an OPC drum 200 is inserted into the housing assembly and rotates the gear assembly 300 (see FIG. 1), which will be described later, while the OPC drum 200 is being rotated.

Figure 3:
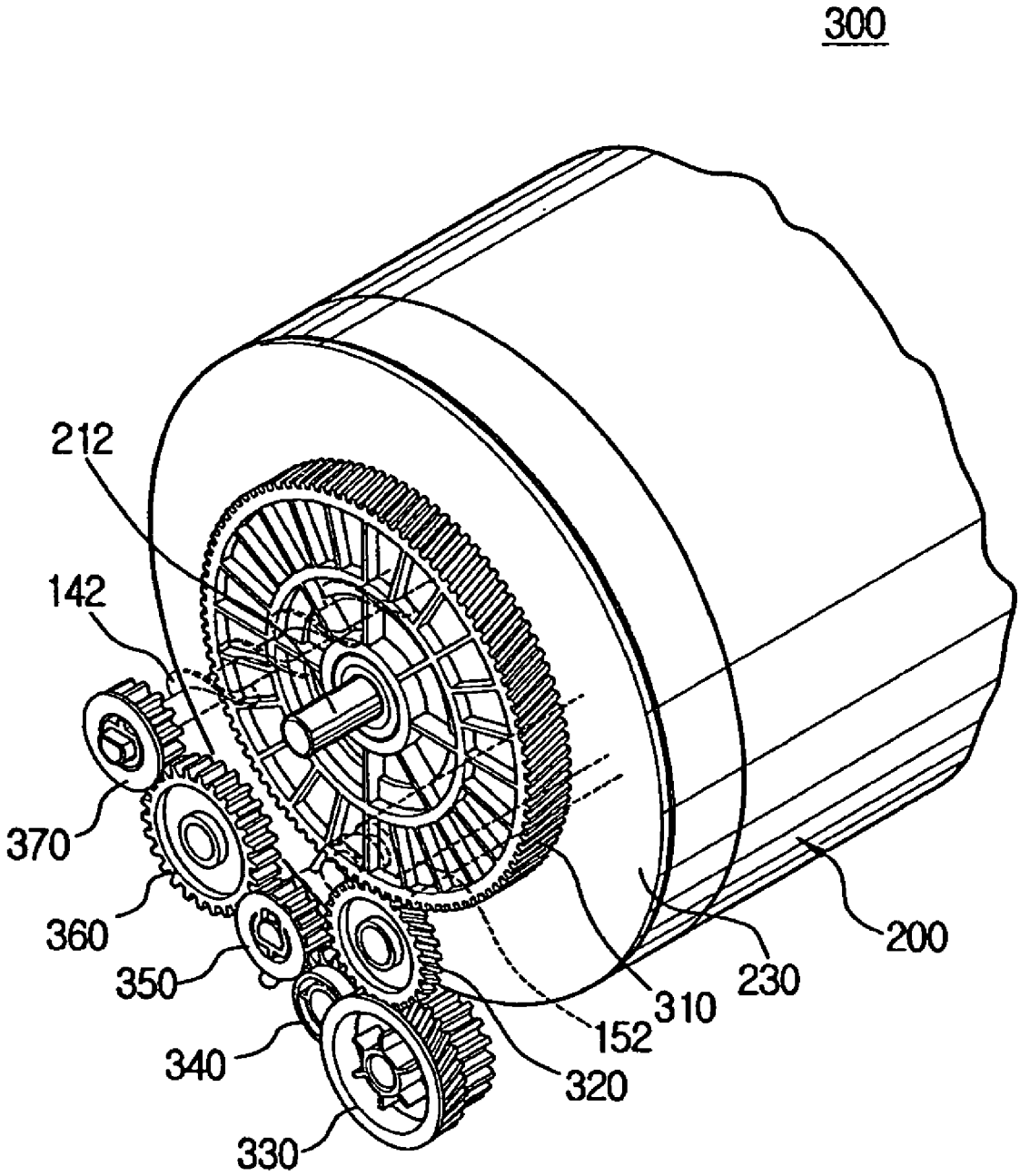
FIG. 3 is a perspective view illustrating a gear assembly according to an embodiment of the present general inventive concept.
Figure 4:
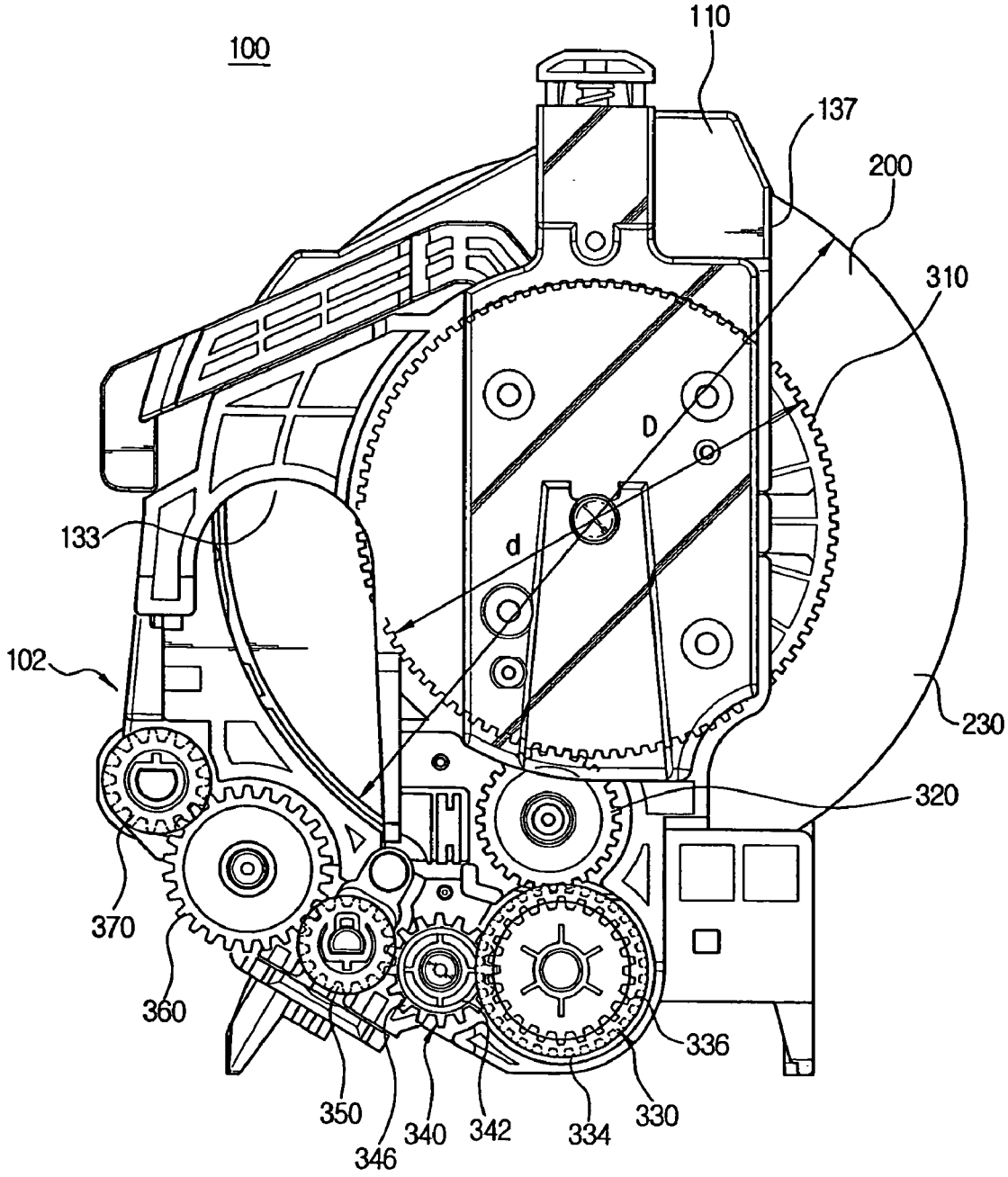
FIG. 4 is a front elevational view illustrating a state in which the gear assembly shown in FIG. 3 is installed in a housing assembly.
Figure 5:
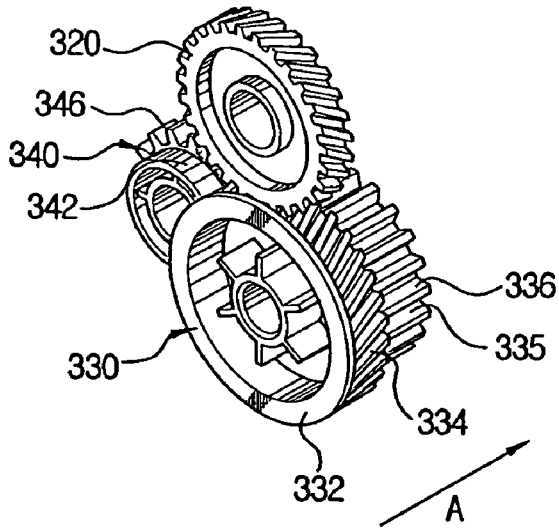
FIG. 5 is a perspective view illustrating first to third idle gears included in the gear assembly shown in FIG. 3.
Figure 6:
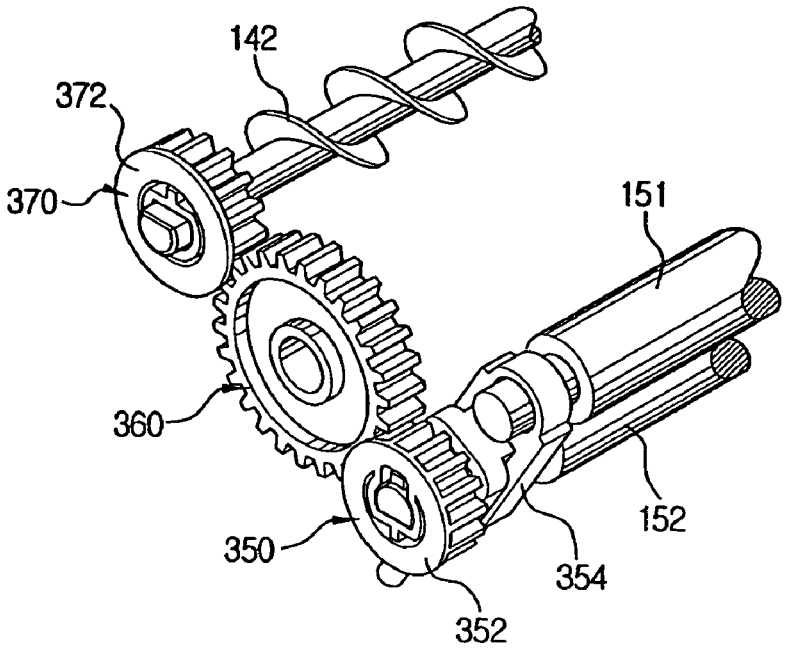
FIG. 6 is a perspective view illustrating a cleaning gear, a fourth idle gear and an auger gear included in the gear assembly shown in FIG. 3.

FIG. 3 is a perspective view illustrating an embodiment of a gear assembly according to the present general inventive concept, FIG. 4 is a front elevational view illustrating a state in which the gear assembly shown in FIG. 3 is installed in a housing assembly, FIG. 5 is a perspective view illustrating first to third idle gears included in the gear assembly shown in FIG. 3, and FIG. 6 is a perspective view illustrating a cleaning gear, a fourth idle gear and an auger gear included in the gear assembly shown in FIG. 3.

As shown in FIGS. 3 to 6, the gear assembly 300 according this embodiment can include a drum gear 310, first to fourth idle gears 320, 330, 340 and 360, a cleaning gear 350 and an auger gear 370.

The drum gear 310 can be projectingly formed on a flange 230 provided on a side of an OPC drum 200, and an outer diameter d of the drum gear 310 is smaller than the outer diameter D of the OPC drum 200, as shown in FIGS. 3 and 4. The drum gear 310 can engage with the first idle gear 320 on the top end of the first idle gear 320. As shown in FIG. 4, when the drum gear 310 is mounted in the housing assembly 102, one side of the drum gear 310 can project toward the main opening 137 and the other side can project toward a power source insertion part 133 so that it engages with the power source (not shown) installed on the main body and thereby rotates. In addition, as shown in FIG. 3, it is an aspect that the drum gear 310 is a helical gear.

The first to third idle gears 320, 330, 340 can engage with the drum gear 310 and the cleaning gear 350, as shown in FIGS. 3 to 5, and hence serve to transmit the rotational force of the drum gear 310 to the cleaning gear 350. Furthermore, the first idle gear 320 engages with the drum gear 310 and can be a helical gear. The second idle gear 330 rotates in the state of being engaged with the first idle gear 320 and the third idle gear 340 and can be provided with a flange 332 (see FIG. 5) on a side thereof, thereby preventing the first idle gear 320 and the third gear 340 from slipping away from the housing assembly 102. The second idle gear 330 can be a double gear, which can be divided into a helical gear section 334 engaging with the first idle gear 320 and a plain gear section 336 engaging with the third idle gear 340. Because the plain gear section 336 is more deeply positioned toward the housing assembly 102 than the helical gear section 334 (in the direction indicated by arrow A in FIG. 5), it is also possible to install the third idle gear 340 more deeply toward the housing assembly (in the direction A), whereby the volume of the OPC unit 100 can be reduced. The third idle gear 340 rotates in the state of being engaged with the second idle gear 330 and the cleaning gear 350 and can be divided into a gear section 346 and a ring section 342 (see FIG. 5). The gear section 346 can include a plain gear engaging with the second idle gear 320 and the cleaning gear 350, and the ring section 342 can project from the front of the gear section 342 as shown in FIGS. 4 and 5, thereby being caught by the inner side 335 of the helical gear section 334 in the second idle gear 330, whereby the third idle gear 340 is prevented from slipping away from the housing assembly 102 (see FIG. 5).

FIG. 6 shows that the cleaning gear 350 has a smooth surface and is a non-auger member. The cleaning gear 350 can engage with the third idle gear 340 and the fourth idle gear 360 as shown in FIGS. 3, 4 and 6, whereby the cleaning gear 350 receives power from the third idle gear 340 and transmits it to the fourth idle gear 360. One side of the cleaning gear 350 is provided with a flange 352 that prevents the fourth idle gear 360 (see FIG. 6) from slipping away from the housing assembly 102 and rotates the cleaning roller 152 to clean the electrification roller 151. The center part of the cleaning gear 350 can be cut to form a "D" hole in order to enhance the rotational force transmission efficiency.

The fourth idle gear 360 is installed in a side of the housing assembly 102 and transmits rotational force received from the cleaning gear 350 to the auger gear 370. In addition, the fourth idle gear 360 can include a plain gear and can be cut to form a "D" hole so that the end of the auger roller 142 can be fitted into the "D" hole.

The auger gear 370 drives the auger roller 142 that transfers waste toner and receives power from the fourth idle gear 360. One side of the auger gear 370 can be provided with a flange 372 so that the fourth idle gear 360 cannot slip away from the housing assembly 102.

The operational relation of the inventive gear assembly constructed as described above will be described in detail.

Firstly, if the OPC unit 100 is mounted in a main body of an image forming apparatus (not shown), a power source (not shown) can be inserted into a power source insertion part 133 in the housing assembly 102 and transmits a driving force to the drum gear 310 of the OPC drum 200.

When the drum gear 310 is rotated due to the transmitted power, the OPC drum 200 itself rotates and an image is formed on the OPC drum 200. The rotational force is transmitted to the cleaning gear 350 through the first idle gear 320 engaged with the drum gear 310, the second idle gear 330 engaged with the first idle gear 320, and the third idle gear 340 engaged with the second idle gear 330. By this, the cleaning roller 152 rotates in a direction identical to that of the electrification roller 151 and cleans the surface of the electrification roller 151.

As the cleaning gear 350 rotates, the fourth idle gear 360 is rotated and the fourth idle gear 360 rotates the auger gear 370. Therefore, toner removed from the surface of the OPC drum 200 by a cleaning blade 135 (see FIG. 2) is moved toward the toner drop hole 146 and then drops into a waste toner sump (not shown).

As described above, because a gear assembly according to the present general inventive concept and an OPC unit provided with the same are constructed in such a manner that gears to drive a cleaning gear and an auger gear are provided on one side of the housing assembly in a compact form, it is possible to reduce the entire volume of the OPC unit and it is also possible to drive the cleaning roller and the auger roller with one driving source.

According to the present general inventive concept, because a gear assembly providing power transmission is completed concurrently with fitting an OPC drum into an OPC unit, it is easy to assemble the OPC drum and to connect the drum gear with other gears.

Furthermore, according to the present general inventive concept, there are advantages in that it is easy to connect a gear that transmits power from a power source to an OPC unit, in that gear-to-gear engagement efficiency can be enhanced, and in that a slipping away of a gear from the housing assembly does not occur.

Still yet, an OPC unit according to the present general inventive concept includes a gear assembly which can be constructed in such a manner that an auger roller that transfers waste toner and an electrification roller can be driven without a separate power source, whereby it is possible to employ, in a multi-path type color image forming apparatus, a fixed type developer that is easy to control a rotational force and to enlarge the OPC drum.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A gear assembly of an organic photoconductive (OPC) unit provided in an image forming apparatus separately from a developing unit and comprising a OPC drum on which an electrostatic latent image is formed, the gear assembly comprising:

a drum gear formed on a flange of an OPC drum of the OPC unit which is provided separately from the developing unit, the drum gear having an outer diameter smaller than that of the OPC drum;

a cleaning gear driven by receiving power from the drum gear; and at least one idle gear interposed between the drum gear and the cleaning gear and transmitting the rotational force of the drum gear to the cleaning gear.

2. The gear assembly according to claim 1, wherein the at least one idle gear interposed between the drum gear and the cleaning gear comprises a first idle gear engaging with the drum gear, a third idle gear engaging with the cleaning gear, and a second idle gear engaging with the first and third idle gears.

3. The gear assembly according to claim 1, wherein the drum gear includes a helical gear.

4. The gear assembly of claim 1, further comprising:

an auger gear rotated by receiving power from the cleaning gear.

5. The gear assembly according to claim 4, further comprising at least one idle gear interposed between the cleaning gear and the auger gear that transmits the rotational force of the cleaning gear to the auger gear.

6. The gear assembly according to claim 5, wherein each of the cleaning gear and the auger gear is provided with a flange on a side thereof in order to prevent the at least one idle gear from slipping away from the gear assembly.

7. An organic photoconductive (OPC) unit of an image forming apparatus comprising:

an OPC drum;

a housing assembly that protects the OPC drum, the housing assembly including a cleaning roller and an auger roller that transfers waste toner; and a gear assembly disposed at the housing assembly that drives the cleaning roller and the auger roller using a power source transmitted from a main body of the image forming apparatus, and includes a drum gear having an outer diameter smaller than that of the OPC drum.

8. The OPC unit according to claim 7, wherein the gear assembly comprises:

a drum gear formed on a side of the OPC drum;

a cleaning gear receiving power from the drum gear and rotating the cleaning roller; and an auger gear receiving power from the cleaning gear and rotating the auger gear.

9. The OPC unit according to claim 8, further comprising at least one idle gear interposed between the drum gear and the cleaning gear to transmit a rotational force of the drum gear to the cleaning gear.

10. The OPC unit according to claim 9, further comprising at least one idle gear interposed between the cleaning gear and the auger gear to transmit a rotational force of the cleaning gear to the auger gear.

11. The OPC unit according to claim 10, wherein each of the cleaning gear and the auger gear is provided with a flange on a side thereof in order to prevent the at least one idle gear from slipping away from the housing assembly.

12. A gear assembly of an organic photoconductive (OPC) unit provided in an image forming apparatus separately from a developing unit and comprising a OPC drum on which an electrostatic latent image is formed, the gear assembly comprising:

a drum gear formed on a flange of an OPC drum of the OPC unit, which is provided separately from the developing unit;

a cleaning gear driven by receiving power from the drum gear; and a first auxiliary gear unit interposed between the drum gear and the cleaning gear and transmitting the rotational force of the drum gear to the cleaning gear.

13. The gear assembly of claim 12, wherein the first auxiliary gear unit comprises plural gears.

14. The gear assembly of claim 12, wherein the drum gear has an outer diameter smaller than that of the OPC gear.

15. The gear assembly of claim 12, further comprising:

an auger gear rotated by receiving power from the cleaning gear.

16. The gear assembly of claim 15, further comprising a second auxiliary gear unit interposed between the cleaning gear and the auger gear that transmits the rotational force of the cleaning gear to the auger gear.

17. The gear assembly of claim 16, wherein the second auxiliary gear unit comprises plural gears.

18. A method of providing a driving power to an image forming apparatus, the method comprising:

driving a non-auger cleaning member with a power received from a rotational force of an optical photoconductive drum gear; and driving an auger member by applying a power received from a rotational force of a cleaning gear of the cleaning member to an auger gear.

19. The method of claim 18, further comprising:

transmitting the rotational force of the drum gear to the cleaning gear through a first auxiliary gear unit; and transmitting the rotational force of the cleaning gear to the auger gear through a second auxiliary gear unit.

20. The method of claim 19, further comprising tuning a distance between the auger gear and the cleaning gear through the second auxiliary gear unit.

21. The method of claim 19, further comprising retaining the second auxiliary gear unit in position with a portion of each of the cleaning gear and the auger gear.

22. The method of claim 21, wherein the portion of each of the cleaning gear and the auger gear that retains the second auxiliary gear unit in position is a circumferential outer portion thereof.

23. The method of claim 18, wherein the driving of the auger member comprises providing power to the optical photoconductive drum gear such that the photoconductive drum gear transfers the power to the cleaning gear to turn the cleaning member, and the cleaning gear in turn transfers the power to the auger gear to turn the auger member.

24. A gear assembly of an organic photoconductive (OPC) unit usable in an image forming apparatus, the gear assembly comprising:

a drum gear formed on a flange of an OPC drum;

a cleaning gear driven by receiving power from the drum gear; and an auger gear driven by receiving power from the cleaning gear;

wherein the drum pear turns the cleaning gear, and the cleaning gear turns the auger gear.

25. The gear assembly of claim 24, further comprising:

a cleaning roller to be rotated by the cleaning gear as the OPC drum is rotated by the drum gear;

an auger roller to be rotated by the auger gear as the cleaning roller is rotated by the cleaning gear; and at least one idle gear interposed between the cleaning gear and the auger gear to transfer the power from the cleaning gear to the auger gear.

26. The gear assembly of claim 24, wherein the drum gear engages a single gear.

27. The gear assembly of claim 24, wherein the cleaning gear and the auger gear are disposed in a continuous arrangement along a circumferential direction of the drum gear.

28. The gear assembly of claim 24, wherein the drum gear transmits a rotational to both the cleaning gear and the auger gear via a single gear.

29. A gear assembly of an organic photoconductive (OPC) unit usable in an image forming apparatus, the gear assembly comprising:

a drum gear formed on a flange of an OPC drum; and a gear train including a plurality of gears arranged around a circumference of the OPC drum such that a selected one of the gears in the gear train engages the drum gear to receive a rotational power from the drum gear and transfer the received rotational power to the other gears in the gear train in a consecutive manner;

and wherein the pear train comprises a helical pear section and a Plain pear section, wherein the plain pear section is more deeply positioned toward the OPC drum than the helical gear section.

30. The gear assembly of claim 29, wherein the plurality of gears in the gear train comprises a cleaning gear of a cleaning member and an auger gear of an auger member.

31. The gear assembly of claim 29, wherein the cleaning gear and auger member transfer the rotational power between each other via an idle gear.

32. The gear assembly of claim 29, wherein the selected gear comprises an idle gear.

33. The gear assembly of claim 29, wherein the gears in the gear train transfer the rotational power one by one.

* * * * *